United States Patent [19]

Ilmoniemi et al.

[11] Patent Number: 4,687,548

[45] Date of Patent: Aug. 18, 1987

[54] METHOD AND APPARATUS FOR CONTROLLING DISTORTION OF FIBRE ORIENTATION IN A PAPER WEB

[75] Inventors: Erkki Ilmoniemi, Vaajakoski; Jouni Koskimies; Markku Lyytinen, both of Jyväskylä; Kari Pitkäjärvi; Esa Ottelin, both of Jyväskylä, all of Finland

[73] Assignee: Valmet Oy, Finland

[21] Appl. No.: 791,910

[22] Filed: Oct. 28, 1985

[30] Foreign Application Priority Data

Oct. 31, 1984 [FI] Finland ..... 844276
Feb. 15, 1985 [FI] Finland ..... 850638

[51] Int. Cl.[4] ..... D21F 1/02
[52] U.S. Cl. ..... 162/216; 162/336
[58] Field of Search ..... 162/335, 337, 338, 339, 162/340, 216, 212, 344

[56] References Cited

U.S. PATENT DOCUMENTS 2,904,461 9/1959 Washburn et al. ..... 162/216
2,956,623 10/1960 Ikavalko ..... 162/336
2,973,034 2/1961 White, Jr. ..... 162/339
3,092,538 6/1963 Parker ..... 162/338
3,434,923 3/1969 Dennis ..... 162/336
3,516,905 6/1970 Dennis et al. ..... 162/337
3,619,362 11/1971 Parker ..... 162/317
3,853,695 12/1974 Back et al. ..... 162/338
4,285,767 8/1981 Page ..... 162/216

*Primary Examiner*—S. Leon Bashore
*Assistant Examiner*—K. M. Hastings
*Attorney, Agent, or Firm*—Steinberg & Raskin

[57] ABSTRACT

Method and apparatus in the head box of a paper machine for controlling the distortion of fibre orientation in the paper web comprise an arrangement wherein by-pass flows of pulp suspension are passed through opposite passages lateral of the turbulence generator preceding the slice portion or discharge channel of the head box. The magnitude and/or the mutual relationship of the by-pass flows is adjusted to control the distortion of the fibre orientation in that the by-pass flows produce a transverse flow in the discharge flow of the pulp suspension from the head box, the speed of which compensates for the distortion of the fibre orientation.

26 Claims, 7 Drawing Figures

METHOD AND APPARATUS FOR CONTROLLING DISTORTION OF FIBRE ORIENTATION IN A PAPER WEB

BACKGROUND OF THE INVENTION

The present invention relates generally to methods and apparatus in paper machines and, more particularly, to methods and apparatus in the head box of a paper machine for controlling the distortion of fibre orientation in the paper web.

It is known that the speed of the discharge flow of the pulp suspension from the head box must be uniform in the transverse direction of the paper machine. It is also known that if the transverse speed of the pulp suspension flow discharging from the head box is unduly high, the quality of the paper produced may be detrimentally affected. In particular, an unduly high transverse speed in the discharge flow of the pulp suspension results in increased lateral wave formation at the lateral portions of the web. However, paper production is normally subject to requirements that the paper produced be homogeneous over the entire width of the web with respect to grammage, formation and strength properties so that as little as possible of the web edges must be cut off.

In order to meet these requirements, it has been suggested to remove a small portion of the pulp suspension flow through both of the side walls of the discharge channel of the head box before the suspension flow is discharged onto the forming wire. See, for example, Finnish Pat. No. 43.812 (U.S. Pat. No. 3,434,923) of Beloit Corporation. Another contrary solution has been suggested wherein an additional flow of water is passed through the side wall of the head box and in this connection reference is made to Finnish Pat. No. 30,095 (U.S. Pat. No. 2,956,623) of Valmet Oy.

The above-described requirements imposed on paper production have been increased and new requirements for the uniformity in the structure of fine paper have resulted from the recent development of certain printing methods, such as sheet-heating copying developed by Xerox and continuous-formedheating copying. These increased requirements are essentially due to the rapid and intensive heating of the sheet that takes place during the printing process. These new printing methods impose the particular requirement that the main axes of the directional distribution or orientation of the fibre network in the paper should coincide with the directions of the main axes of the paper and that the orientation should be symmetrical with respect to these axes.

Sufficient satisfaction of the particular requirement described above over the entire width of the web has not been possible in practice by means of the above-described prior art suggestions nor by means of any other known construction of the paper machine head box. For example, areas are usually present in the web which are not acceptable in view of the requirement described above. Paper produced by conventional methods are generally subject to the deficiencies of diagonal bending of the sheets or "falling" of a stack of forms.

Studies conducted by applicants' assignee have shown that it is possible to obtain the required symmetry of fibre orientation by ensuring that the transverse speed of the pulp suspension being discharged from the head box does not exceed about 2 to 3 cm/s. Since the transverse flow of pulp suspension is produced in the discharge channel of the head box as the uneven main flow profile is attenuated, the majority of effort must be directed to obtaining uniformity of the speed profile in the direction of pulp suspension flow after the turbulence generator. Even if it were possible to construct the distribution system of the head box in the correct manner and to construct turbulence generators so precisely that the transverse speed requirements are met, such constructions would be so costly in manufacture as to be commercially unprofitable.

SUMMARY OF THE INVENTION

Accordingly, it is an object of the present invention to provide new and improved methods and apparatus for controlling distortion of fibre orientation in a paper web.

Another object of the present invention is to provide new and improved methods and apparatus by which it is possible to control the profile of the distortion of fibre orientation at the head box of the paper machine so that slight lack of precision in the manufacture of the head box can be tolerated.

Briefly, in accordance with the present invention, these and other objects are attained by a method including the steps of passing by-pass flows of pulp suspension into and through respective lateral passages situated at lateral sides in the flow channel of the head box substantially in the region of the turbulence generator thereof, and adjusting at least one of the magnitude and mutual relationship of the pulp suspension by-pass flows to produce a transverse flow in the pulp suspension which is discharged from the head box having a speed which compensates for the distortion in the fibre orientation.

In accordance with the apparatus of the invention, a pair of lateral passages are provided situated at lateral sides of the flow channel of the head box through which by-pass flows of pulp suspension are passed. Means are provided for adjusting at least one of the magnitude and mutual relationship of the pulp suspension by-pass flows to produce a transverse flow in the pulp suspension discharged from the head box having a speed which compensates for the distortion in the fibre orientation.

The adjusting means comprise a pair of adjusting members, each of which is movably mounted in connection with openings, grooves, recesses, or the like provided in a respective one of the lateral side walls of the head box. The inner side of each adjusting member defines an outer side of a respective lateral passage. Means are provided for adjusting the position of each of the adjusting members to adjust the by-pass flows in the lateral passages to control the distortion of the fibre orientation.

In accordance with the invention, it is possible to provide either external by-pass flows in the lateral passages taken, for example, from the distribution beam of the head box, and/or the by-pass flows through the lateral passages can be obtained from the lateral portions of the pulp suspension flow channel which are arranged so as to be adjustable to change the flow resistance or choking in the lateral passages. In the latter case, in order to provide a sufficient range for adjustment, the lateral passages are dimensioned so that the flow resistance presented by them is substantially lower than the flow resistance of the turbulence generator situated between the lateral passages per unit area of the flow channel.

The invention is based on a system wherein the flows in both of the lateral areas of the head box can be controlled within an area having a width of a few centimeters so that the flow discharged from the turbulence generator into the discharge channel of the head box can be adjusted over a sufficiently wide range.

The operation of the method of the invention is based on the theory of narrowing discharge channel flow which has been experimentally verified. The principle under which the invention operates can be described, somewhat simplified, as follows. If the pulp suspension flow within one lateral area of the discharge channel of the head box is increased in excess of the average flow, a constant transverse flow directed towards the opposite lateral edge is produced in the pulp suspension within the discharge channel and, additionally, on the forming wire. The maximum value of the transverse flow is obtained at the lateral edge of the area in which the flow is increased and the value decreases from this area in a uniform manner towards a zero value in the direction of the other edge of the discharge channel. If the supply of pulp suspension is increased in an equal magnitude at the other edge an opposite transverse flow symmetrical to the first one is obtained. These opposite transverse flows have an additive effect and result in the transverse flow profile having a maximum value at each lateral edge towards the center while the transverse flow at the middle of the machine is zero as the substantially equal and opposite transverse speeds cancel or compensate for each other. Correspondingly, measurements of the paper produced indicate that maximum values of different directions are obtained for the distortion of orientation at the edges and a symmetry of orientation at the middle of the web. Therefore, the graph of the distortion of orientation is an inclined straight line which intersects a zero value at the middle of the web. If for some reason the graph representing distortion of orientation has an inclination of equal magnitude but reverse in direction prior to a corrective adjustment in accordance with the invention, the adjustment in accordance with the invention will eliminate the distortion. Correspondingly, the correction of an orientation distortion whose graph inclines in the same direction requires both of the lateral flows to be reduced by a corresponding amount rather than increased.

It is seen from the foregoing that a diagonal distortion profile of the fibre orientation can be corrected in accordance with the principle of the invention by either increasing or reducing the pulp suspension flows within the lateral areas of the discharge channel of the head box.

If one of the lateral by-pass flows is increased while the other lateral by-pass flow is reduced to the same extent, the transverse flow effects will be in the same direction so that when such effects are added, a transverse speed component of constant magnitude is produced across the web. Further, if a transverse flow of constant speed but of opposite direction in the web exists prior to an adjustment in accordance with the invention, the corrective adjustment will eliminate the orientation distortion of constant magnitude. In order to align a fibre orientation which is evenly distorted in an opposite direction, the directions of the changes of the flow are reversed within the adjustment areas.

Thus, a uniform distortion profile of the fibre orientation can only be corrected by means of the invention by changing the magnitude and direction of the lateral by-pass flows through the head box.

By suitably combining the two adjustment operations described above, the graph representative of the distortion of fibre orientation can be both rotated with respect to a center point and vertically shifted both upwardly and downwardly so that it is therefore possible to practically completely correct any distortion error arising from non-uniform flow at or near the edge of the head box, which comprises most of the cases in practice. If the source of distortion error is not at the edge of the head box, complete correction of distortion cannot be achieved through adjustments in accordance with the invention. For example, if the source of error results from a uniform diagonal speed profile of the pulp suspension flow, a graph of the orientation distortion will comprise either an upwardly or downwardly opening parabola, whose ordinates at the edges are zero. By means of the adjustments described above, the maximum value at the middle of the web can be reduced to one-half of the original value in which case an equal but opposite distortion is produced at the edges. The maximum error, however, is reduced to one half of its original value.

The width of each lateral adjustment zone will depend upon the magnitude of the profile errors that must be corrected. An excessively narrow adjustment zone implies that the necessary change in flow speed is so high that a detrimentally high step is produced in the discharge channel.

The effect of such a disturbance may extend further within the area of the finished web and manifest itself, for example, in the grammage profile. On the other hand, the adjustment area should not be extended into the area of the readycut final product since it is difficult to control all of the required properties of the paper within the adjustment area at the same time. In practice, the width of the adjustment zone will generally be in the range of between about 20 to 100 mm in both edges.

The prior art solutions described above do not meet the requirements imposed on the finished paper for at least two reasons. Firstly, lateral flow is not passed through openings situated at the trailing edge of the turbulence generator into the discharge channel which is important in the prevention of the formation of transverse flow. Secondly, the range over which the prior art solution has any effect extends only in the immediate proximity of the lateral side wall and indeed the objective of the prior art solution is to reduce lateral friction. Accordingly, the range of effect is considerably narrower as compared to the present invention.

In comparing the present invention to a prior art solution in which it is attempted to minimize the distortion of fibre orientation through appropriate sizing of the openings in the grid plates at the inlet side of the turbulence generator of the head box which open into lateral passages of the turbulence generator, an important advantage of the present invention is readily seen. In particular, in accordance with the prior art solution, it is frequently necessary to change the grid plate in order to obtain the correct flow in the lateral passages of the turbulence generator. In accordance with the invention, however, adjustment means are provided for by-pass flow pipes so that it is possible to quickly obtain the correct values for the by-pass flows through the lateral passages. Compensation for the distortion of the flow orientation in accordance with the present invention can be accomplished in an automatic manner, if desired, such as by connecting the adjustment means to an automatic control system already operating in conjunction with the paper machine.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
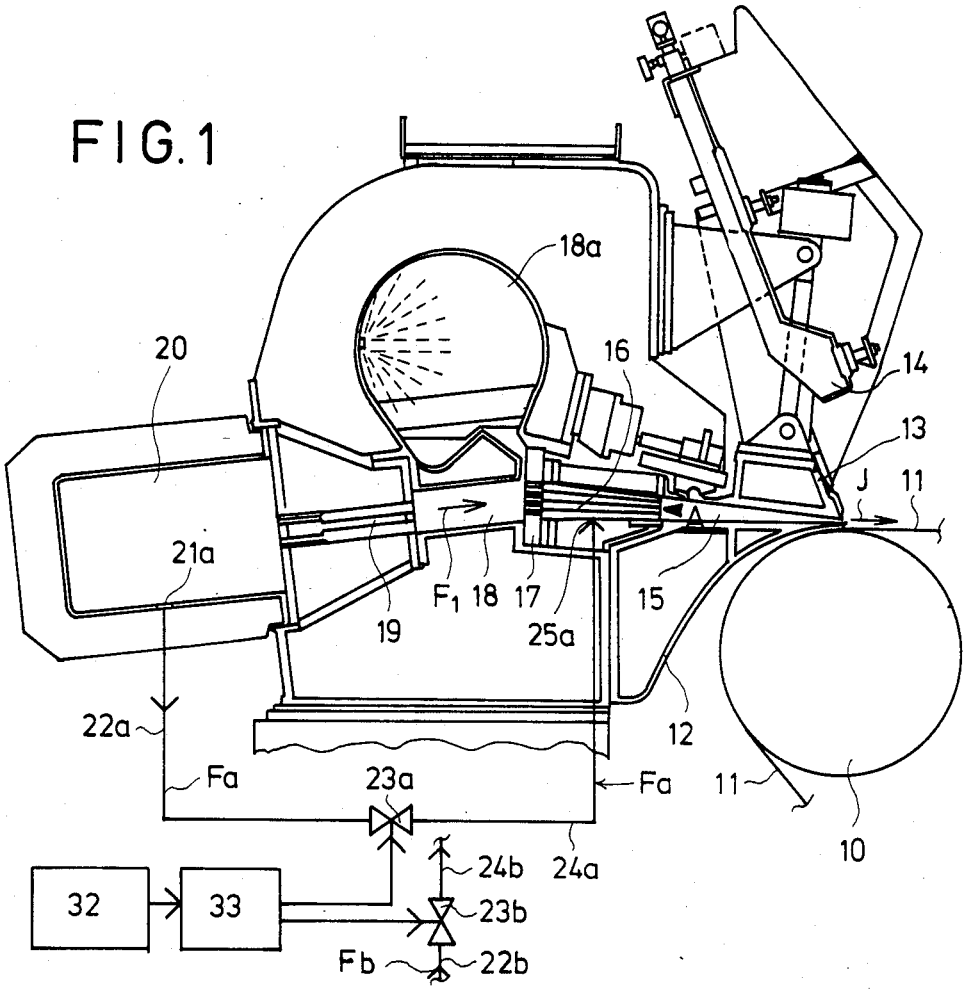
FIG. 1 is a side elevation view in section of a head box in which apparatus for performing the method in accordance with the invention is illustrated schematically and in block diagram form.
Figure 2:
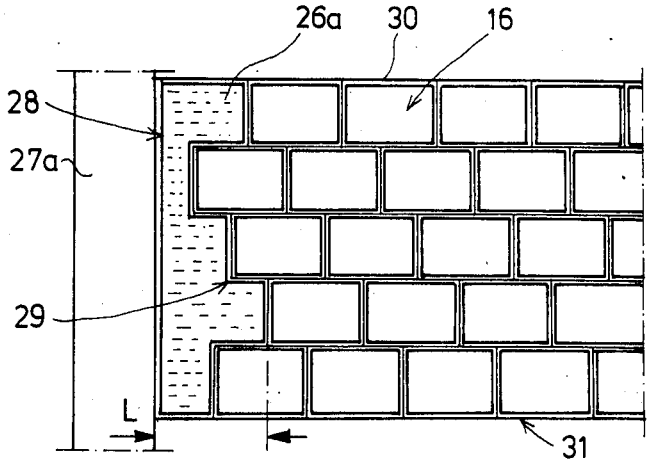
FIG. 2 is a partial view of the turbulence generator of the head box of FIG. 1 in the direction designated A.
Figure 3:
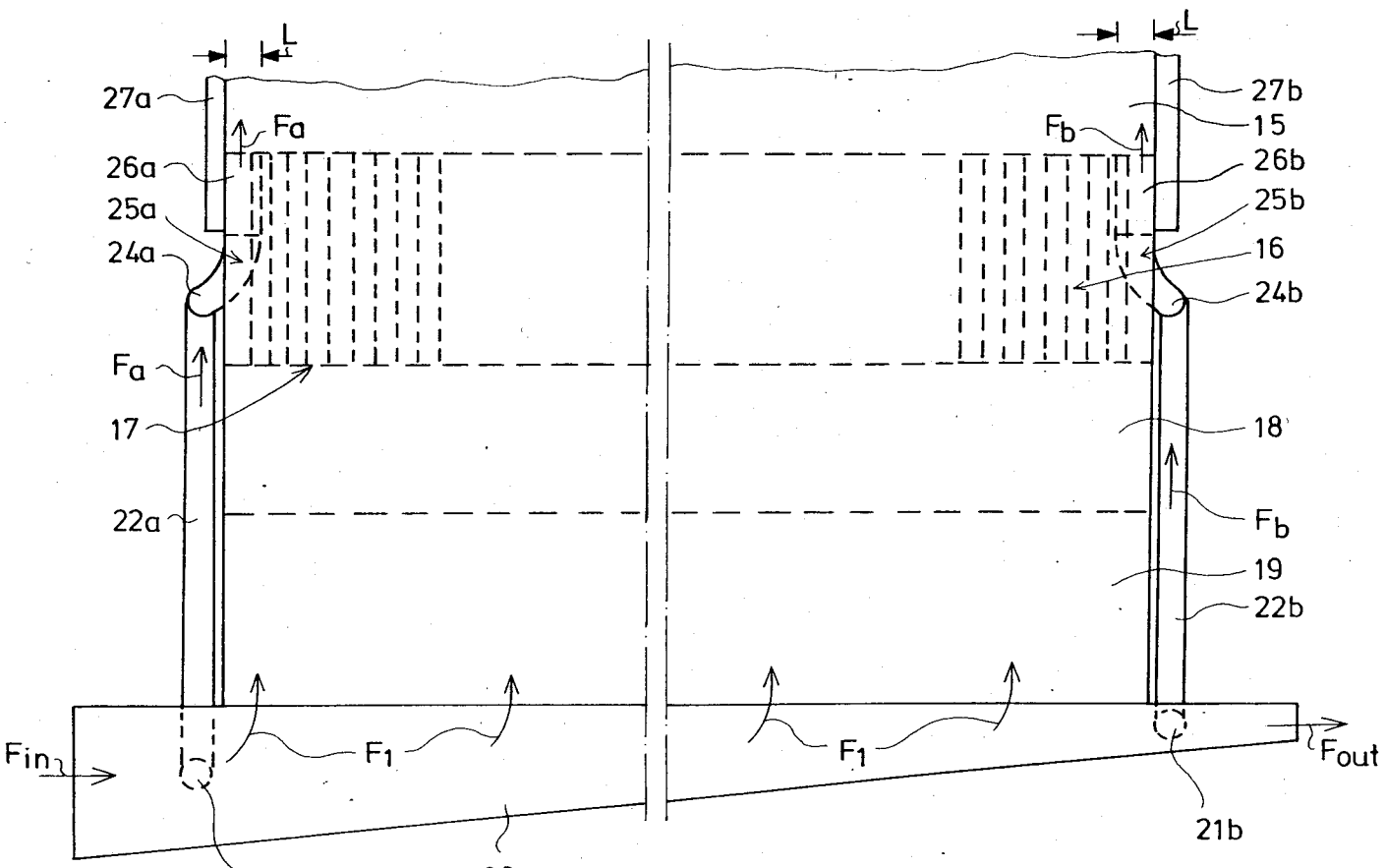
FIG. 3 is a schematic top plan view of the head box of FIG. 1.

Referring now to the drawings wherein like reference characters designate identical or corresponding parts throughout the several views, and more particularly to FIGS. 1–3, a pulp suspension jet J is fed from the head box shown in FIG. 1 onto the forming wire 11 which runs over a breast roll 10. The discharge channel or slice 15 of the head box is defined by the top wall of the lower lip beam 12 and the bottom wall of the upper lip beam 13. The upper lip beam can be adjusted by conventional position adjustment mechanisms 14. The discharge channel 15 of the head box is preceded in the direction of feed F by a turbulence generator 16 which in the illustrated embodiment comprises flow pipes of rectangular cross section arranged in rows which are offset so that vertically adjacent flow pipes are staggered with respect to each other. The flow pipes communicate at their entry ends with respective circular openings formed in a grid plate 17, the circular cross section being changed to rectangular at the outlet side of the turbulence generator.

Referring to FIGS. 2 and 3, lateral passages **26*a* and 26*b* are situated at lateral sides in the flow channel of the head box in the region of the turbulence generator. The lateral passages 26*a* and 26*b* have polygonal cross sections seen in FIG. 2. As described in greater detail below, by-pass flows $F_a$ and $F_b$ of pulp suspension are passed into and through the lateral passages 26*a* and 26*b***.

The head box includes an equalization chamber 18 preceding the grid plate 17. An air tank **18*a* is situated above the equalization chamber 18 in communication therewith and serves to equalize and dampen pressure pulsations in the pulp suspension flow. The pulp suspension is fed from a distribution beam 20 whose longitudinal direction extends transversely to the direction of suspension flow within the head box through a system of distribution pipes 19 into the equalization chamber 18. In FIG. 3, the pulp suspension flow entering the distribution beam 20 is designated $F_{in}$ and the portion of the flow which entirely by-passes the head box is designated $F_{out}$. Of the total flow passing into the head box, $F_{in}$-$F_{out}$, the main headbox flow $F_1$ enters the head box through the set of distribution pipes 19**.

In accordance with the illustrated embodiment of the invention, by-pass pipes **22*a* and 22*b* directly fluidly communicate the distribution beam 20 and respective lateral passages 26*a* and 26*b*, i.e., the by-pass pipes 22*a* and 22*b* by-pass the set of distribution pipes 19 and equalization chamber 18 and communicate directly with both of the lateral passages 26*a* and 26*b* lateral of the turbulence generator 16. The by-pass pipes 22*a* and 22*b* are joined to the distribution pipe 20 at connections 21*a* and 22*b* which are respectively situated at or laterally outside of the side walls 27*a* and 27*b* of the head box in the width direction thereof. The by-pass pipes 22*a* and 22*b* are connected to the respective lateral passages 26*a* and 26*b* by means of extensions 24*a* and 24*b***.

The by-pass pipes **22*a*, 24*a* and 22*b*, 24*b* are provided with respective control valves 23*a* and 23*b* (FIG. 1) and are dimensioned so that by-pass flows of pulp suspension $F_a$ and $F_b$ are produced by means of the normal difference in pressure in the head box without the need for additional pumps. It is understood that pumps may be provided when necessary to obtain sufficiently large flows $F_a$ and $F_b$. The by-pass pipes 22*a*, 22*b* and 24*a*, 24*b* are passed through openings 25*a* and 25*b* provided in the plane side walls 28 of lateral passages 26*a* and 26*b* so that the by-pass flow $F_a$ and $F_b$ can be introduced into the lateral passages 26*a* and 26*b* in a smooth fashion. In the embodiment of the invention illustrated in FIGS. 1–3, the inlet ends of the lateral passages 26*a* and 26*b*, i.e., the ends situated at the grid plate 17, are completely closed so that the pulp suspension flows $F_a$ and $F_b$ in the lateral passages are obtained solely from the by-pass pipes 22*a*, 24*a* and 22*b*, 24*b*. However, in certain cases, the by-pass flows $F_a$ and $F_b$ are obtained from the pulp suspension flowing from the by-pass pipes combined with pulp suspension coming from the equalization chamber 18 through the openings in the grid plate 17. In such a case, the openings in the grid plate are dimensioned so that the flow resistance presented thereby is sufficiently high relative to the flow resistance of the by-pass flow passages 26*a* and 26*b*** that a sufficiently large range of adjustment of the by-pass flows $F_a$ and $F_b$ is obtained.

The lateral passages **26*a* and 26*b* into which the adjustable by-pass flows are passed in accordance with FIGS. 1–3 extend over the entire height of the turbulence generator 16, i.e., between the top wall 30 and the bottom wall 31. In certain cases, the by-pass feed may be of a lesser height. In addition to the walls 30 and 31, the lateral passages 26*a* and 26*b* are defined by respective plane vertical walls 28 and by opposed, stepped walls 29, the configuration of the latter being determined by the staggered nature of the flow passages of the turbulence generator. The flow passages of the turbulence generator are staggered in the manner shown in FIG. 2** in order to prevent formation of vertical disturbances in the pulp suspension flow as is known.

In accordance with the embodiment shown in FIGS. 1–3, the pulp suspension flows are passed from the distribution beam 20 or the like through connections **21*a* and 21*b* into by-pass pipes 22*a* and 22*b* respectively which are provided with control valves 23*a* and 23*b* respectively. The control valves 23*a* and 23*b* may be manually controlled to adjust the quantity and/or mutual relationship of the by-pass flows $F_a$ and $F_b$. The settings of valves 23***a* and 23*b* can be pre-determined experimentally for obtaining the best possible compensation of the distortion of fibre orientation. Alternatively or in addition, the by-pass flows $F_a$ and $F_b$ can be adjusted by means of valves 23*a* and 23*b* or by equivalent means in automatic manner. For example, referring to FIG. 1, the fibre orientation and its distortion can be measured from the web being produced in an on-line manner by apparatus designated 32 which then sends a signal to a control unit and actuating motor, designated 33, by means of which the valves 23*a* and 23*b* are adjusted.

Reference will now be had to FIGS. 4–7 wherein additional embodiments of the invention are illustrated.

Figure 4:
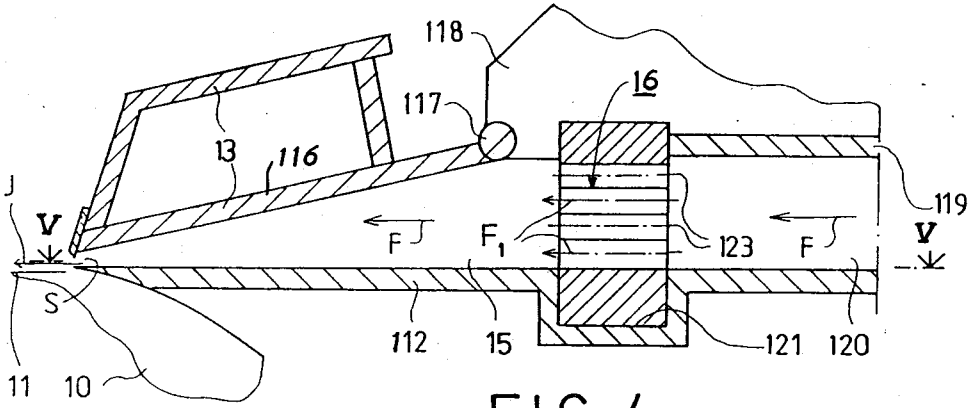
FIG. 4 is a side elevation view in section of the lip portion of a head box of a paper machine in accordance with and the embodiment of the invention.

In the embodiments shown in FIGS. 4–7, turbulence generator 16 comprises a plurality of tubular flow passages 23 arranged in side-by-side fashion both vertically and horizontally. As seen in FIG. 4, the turbulence generator 16 is mounted between walls 119 of the equalization chamber 120 within a groove 121 provided at the joint between chamber wall 119 and the lower wall 112 of the discharge chamber or slice. The turbulence generator 16 may, for example, be formed from a massive member in which a plurality of through-bores are formed and through which the pulp suspension flows. The pulp suspension flow is fed from the distribution beam of the head box through a set of distribution pipes (not shown) into the equalization chamber 120 from where it flows through flow passages 123 as flows F in the turbulence generator 16 into the discharge channel 15. The magnitude of the slice s can be selectively modified by adjusting a profile bar 115 and/or by pivotting the upper lip beam 116 around its articulated joint 117 which connects the lip beam 116 to the upper frame 118.

Lateral passages 26 are provided at respective lateral sides of the turbulence generator 16, partially defined by respective vertical side walls 125 of the flow channel of the head box. By-pass flows $F_o$ of pulp suspension are introduced into the lateral passages 26 while by-passing the turbulence generator 16. In the embodiments illustrated in FIGS. 4–7, the by-pass flows $F_o$ are obtained from the equalization chamber 120 of the head box, pass through respective lateral passages 26 from where they are discharged into the discharge channel 15. Both of the by-pass flows $F_o$ are adjustable in accordance with the invention to provide a control for the distortion of the fibre orientation in accordance with the principles discussed above.

In order to adjust the by-pass flows $F_o$, adjustment means 130 (FIG. 5), 140 (FIGS. 6 and 7) are provided which are movably mounted in openings formed in the side walls of the head box so as to adjust the cross section of the lateral passages. Thus, in the embodiments of FIGS. 4–7, the means for adjusting the magnitude and/or mutual relationship of the pulp suspension by-pass flows through the lateral passages comprise a pair of adjusting members 131;141, each of which is movably mounted on a respective one of the lateral side walls of the head box and having an inner side which defines an outer side portion of the respective lateral passage.

Figure 5:
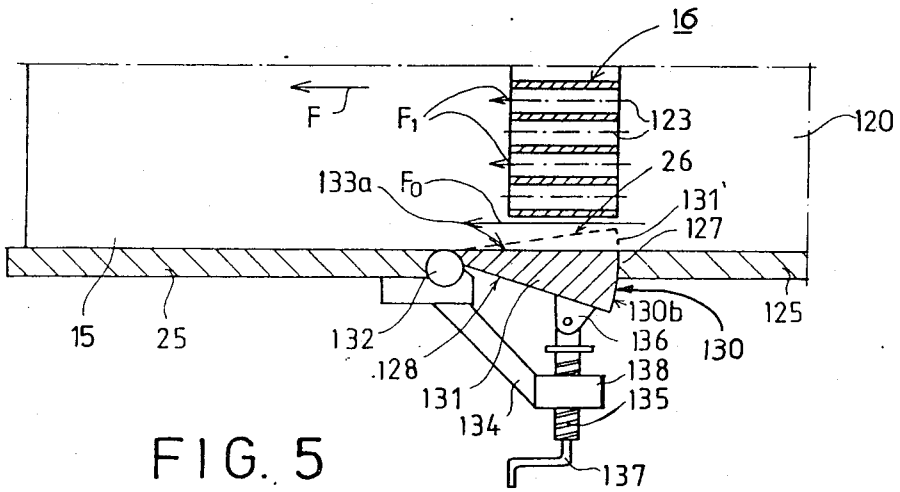
FIG. 5 is a section view taken along line 5—5 of FIG. 4.

Referring to FIG. 5, the adjusting members 131 each comprise, in a horizontal section, a sector-shaped member having a plane inner side 133*a* and an outer side 130*b* shaped as a part of a circular cylinder. The adjusting member 131 is pivotally mounted at its narrow edge to a respective one of the side walls 125 at a vertical joint 132 so that the member 131 can rotate about joint 132. A fluid seal 127 is provided in the opening 128 of wall 125 at side 130*b*. Means for moving each of the adjusting members 131 are provided in the form of an adjusting screw 135 connected to the adjusting member 131 by means of a link pin 136. Adjusting screw 135 is provided with a crank 137 by means of which manual adjustment of the position of adjusting member 131 is accomplished. The adjusting screw 135 passes through a threaded member 138 attached to the side wall 125 by a support arm 134.

Still referring to FIG. 5, the adjusting member 131 can be moved inwardly to an inner position, shown in phantom at 131', wherein the flow section of the lateral passage 26 is substantially reduced to choke the lateral flow $F_o$. It is understood that both adjusting members 131 of both lateral passages 26 are similarly adjusted in the manner described above.

Figure 7:
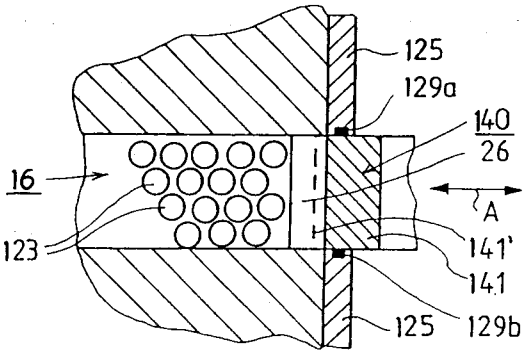
FIG. 7 is a partial front section view of the head box illustrated in FIG. 6 taken through the turbulence generator.
Figure 6:
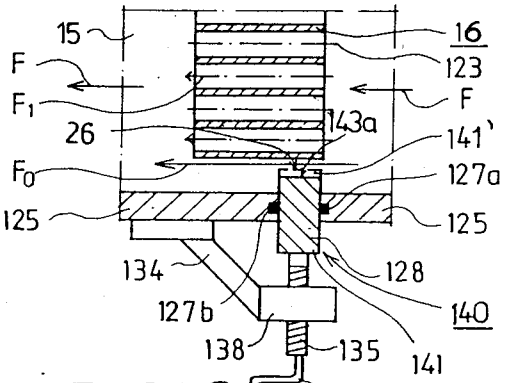
FIG. 6 is a view similar to FIG. 5 illustrating another embodiment of the invention.

Referring to FIGS. 6 and 7, the adjusting means 140 comprise slideable adjusting members 141, each of which is situated in a rectangular opening 128 in a respective side wall 125 and surrounded by fluid seals 127*a*, 127*b* and 129*a*, 129*b*. The slideable adjusting members 141 situated in both of the lateral walls 125, are adjustably moved by means of a screw mechanism 135–138, described above in connection with the embodiment of FIG. 5, to adjust the flow sections of both of the lateral passages 26. In the embodiments of FIGS. 4–7, the lateral passages 26 preferably extend over the entire height of the head box flow channel 120. The inner fully choked position of the slideable adjusting members 141 are shown in phantom in FIGS. 6 and 7 and designated 141'.

As seen from FIGS. 4–7, in the unchoked state, i.e., wherein the adjusting members are in their outward positions, the flow resistances of the lateral passages 26 are substantially lower than the flow resistance of the adjoining turbulence generator 16 per unit of area of the pulp suspension flow channel. In this manner, it is ensured that while in the unchoked condition, the speed of the lateral by-pass flows $F_o$ passing through the lateral passages 26 is higher than the speed of the flows F passing through the channels 123 of the turbulence generator 16. By adjusting the speed of the lateral flows $F_o$ by means of the adjusting members 131, 141, the distortion of the fibre orientation is controlled.

It will be understood that in accordance with the invention, the adjusting means of the invention for the lateral passages 26 or for corresponding flow sections, and choking devices for the lateral flows $F_o$, can take forms other than as shown in the figures as described herein. The by-pass flow adjusting means may in accordance with the invention, for example, be connected with an automatic system including devices by means of which the fibre orientation of the web being produced is measured in an on-line fashion. The adjusting means may include adjustment units and actuating motors which are in themselves known by means of which the position of the adjusting members or "valves" 131, 141 are changed in order to control the distortion of the fibre orientation in the web.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper machine including a head box having a flow channel including a turbulence generator having main flow passages therethrough and a discharge channel through which a main flow of pulp suspension flows in a flow direction, a method for controlling distortion of fibre orientation in the paper web, comprising the steps of:

passing by-passing flows of pulp suspension in the flow direction through respective lateral passages situated in the flow channel at lateral sides of the head box substantially in the region of the turbulence generator, said bypass flows by passing said main flow passages of said turbulence generator, said lateral passages being separate from said turbulence generator and extending along at least a portion of the length of said turbulence generator with said turbulence generator being situated between said lateral passages; and adjusting at least one of the magnitude and mutual relationship of the speeds of said pump suspension by-pass flows with respect to the speed of the main pulp suspension flowing through said turbulence generator main flow passages to produce a transverse flow in the pulp suspension discharged from the head box having a speed which compensates for the distortion in the fibre orientation to thereby control the distortion of the fibre orientation.

2. The method of claim 1 wherein the paper machine includes a distribution beam from which the pulp suspension is passed into the flow channel of the head box, and including the further step of passing the pulp suspension by-pass flows from the distribution beam into the lateral passages.

3. The method of claim 2 wherein the distribution beam longitudinally extends in a transverse direction with respect to the pulp suspension flow direction and wherein the pulp suspension by-pass flows are discharged from the distribution beam at respective connections situated substantially at or outside the respective lateral passages in the longitudinal direction of the distribution beam.

4. The method of claim 1 wherein the by-pass flows of pulp suspension are passed into the lateral passages through by-pass pipes and wherein the adjusting step is accomplished by adjusting flow control valves provided in the by-pass pipes.

5. The method of claim 4 wherein the control valve adjusting step is accomplished manually.

6. The method of claim 4 wherein the control valve adjusting step is accomplished by an independent control system.

7. The method of claim 4 wherein the control valve adjusting step is accomplished by a control system coupled to the paper machine.

8. The method of claim 1 wherein each of said pulp suspension by-pass flows has a range of effect on the pulp suspension flow discharging from the head box over a lateral zone extending from a corresponding lateral side of the suspension flow towards the midpoint thereof having a width of between about 20 to 100 mm.

9. The method of claim 1 wherein the pulp suspension by-pass flows are discharged from the lateral passages into lateral zones of the discharge channel, and wherein the by-pass flows being discharged into the discharge channel consists only of said by-pass flows.

10. The method of claim 1 wherein the pulp suspension by-pass flows are discharged from the lateral passages into lateral zones of the discharge channel, and including the further step of combining the by-pass flows flowing through the lateral passages with pulp suspension normally flowing into the turbulence generator through openings formed in a grid plate.

11. The method of claim 10 including the step of adjusting the relative amounts of pulp suspension combined in the lateral passages by suitably dimensioning the openings in the grid plate.

12. The method of claim 1 wherein the adjusting step is accomplished by adjusting the magnitude of the pulp suspension by-pass flows by adjusting the flow section of the lateral passages.

13. The method of claim 1 wherein said lateral passages extend substantially over the entire height of the head box flow channel.

14. The method of claim 1 wherein the turbulence generator includes a choking zone and wherein the flow resistance of the lateral passages is substantially lower than the flow resistance of the choking zone of the turbulence generator.

15. In a paper machine including a head box having a flow channel including a turbulence generator having main flow passages therethrough and a discharge channel through which a main flow of pulp suspension flows in a flow direction, apparatus for controlling distortion of fibre orientation in the paper web, comprising:

a pair of lateral passages situated in said head box flow channel at respective lateral sides of said head box substantially in the region of the turbulence generator, said lateral passages bypassing said main flow passages of said turbulence generator, said lateral passages being separate from said turbulence generator and extending along at least a portion of the length of said turbulence generator with said turbulence generator being situated between said lateral passages;

means for passing by-pass flows of pulp suspension through said lateral passages in the flow direction; and means for adjusting at least one of the magnitude and mutual relationship of the speeds of said pump suspension by-pass flows with respect to the speed of the main pulp suspension flowing through said turbulence generator main flow passages to produce a transverse flow in the pulp suspension discharged from the head box having a speed which compensates for the distortion in the fibre orientation to thereby control the distortion of the fibre orientation.

16. The combination of claim 15 wherein the paper machine includes a distribution beam from which the pulp suspension is passed in the flow channel of the head box, and further including a pair of by-pass pipes, each communicating with said distribution beam and a respective one of said lateral passages.

17. The combination of claim 16 wherein the distribution beam longitudinally extends in a transverse direction with respect to the pulp suspension flow direction and wherein the by-pass pipes are connected to the distribution beam at respective connections situated substantially at or outside the respective lateral passages in the longitudinal direction of the distribution beam.

18. The combination of claim 16 further including flow control valves provided in each of said by-pass pipes.

19. The combination of claim 18 further including control means for automatically adjusting the control valves.

20. The combination of claim 15 wherein said head box includes a pair of lateral side walls and wherein said adjusting means comprise a pair of adjusting members, each movably mounted on a respective one of said lateral side walls and having an inner side defining an outer side of a respective lateral passage, and means for adjusting the position of each of said adjusting members to adjust at least one of the magnitude and mutual relationship of said pulp suspension bypass flows through said lateral passages.

21. The combination of claim 20 wherein said adjusting members are mounted in openings formed in said side walls.

22. The combination of claim 20 wherein said means for adjusting the position of said adjusting members comprise one of manual actuating devices and actuating motors.

23. The combination of claim 20 wherein each of said adjusting members is pivotally journaled on a respective one of said side walls for pivotal movement with respect to a substantially vertical axis, and further including means coupled to each of said adjusting members for adjusting the position thereof.

24. The combination of claim 23 wherein said adjusting members are mounted in openings formed in said side walls and wherein each adjusting member comprises a substantially sector-shaped member having a narrow edge at one of its ends mounted on a respective one of said side walls substantially at an edge of a respective opening and a substantially vertical side at another one of its ends in the shape of a circular cylindrical segment contiguous with another edge of said opening, means for providing a fluid seal between said vertical side of each of said adjusting members and said another edge of each of said openings, each of said adjusting members being mounted so that said inner side thereof is substantially in the plane of an inner surface of a respective one of said side walls when said adjusting member is in an open position to provide an unchoked by-pass flow through respective lateral passages.

25. The combination of claim 20 wherein said adjusting members are mounted in openings formed in said side walls and wherein each of said adjusting members is mounted in a respective one of said openings for linear movement into a respective lateral passage to choke by-pass flow therethrough, and means coupled to each of said adjusting members for adjusting the position thereof.

26. The combination of claim 15 wherein said adjusting members are situated at said turbulence generator, said turbulence generator being situated between an equalization chamber of said head box and said discharge channel.

* * * * *